US006289700B1

(12) United States Patent
Gangi et al.

(10) Patent No.: US 6,289,700 B1
(45) Date of Patent: Sep. 18, 2001

(54) METHOD OF MAKING MULTI-SEGMENTED CHENILLE YARNS ON A CROCHET KNITTING MACHINE

(76) Inventors: Richard P. Gangi, HC2, Box 7, Rte. 145, Durham, NY (US) 12422; Robert Joseph Gangi, 17018 Brookwood Dr., Boca Raton, FL (US) 33496

( * ) Notice: Subject to any disclaimer, the term of this patent is extended or adjusted under 35 U.S.C. 154(b) by 0 days.

(21) Appl. No.: 09/566,781

(22) Filed: May 8, 2000

(51) Int. Cl.[7] ..... D04B 23/16
(52) U.S. Cl. ..... 66/85 R; 28/144; 57/203
(58) Field of Search ..... 28/144, 143; 66/1 R, 66/83, 84 R, 85 R, 84 A, 169 R, 170, 190, 192, 193, 195, 202; 57/24, 203; 139/393, 395

(56) References Cited

U.S. PATENT DOCUMENTS 2,213,720 * 9/1940 Seim ..... 57/24
2,541,499 * 2/1951 Carney ..... 66/203
2,541,500 * 2/1951 Carney ..... 66/220
2,779,354 * 1/1957 Underwood et al. ..... 66/203
2,845,783 * 8/1958 Underwood et al. ..... 57/24
3,715,878 * 2/1973 Kim ..... 57/24
3,748,874 * 7/1973 Blezard ..... 66/203
4,288,973 * 9/1981 Tani ..... 57/24
4,517,715 * 5/1985 Yoshida et al. ..... 66/203

FOREIGN PATENT DOCUMENTS

2457745 * 6/1976 (DE) .
3106810 * 9/1982 (DE) .

* cited by examiner

*Primary Examiner*—Danny Worrell
(74) *Attorney, Agent, or Firm*—Levine & Mandelbaum

(57) ABSTRACT

Chenille yarns having a spaced dyed appearance of made by crochet knitting a chenille fabric having a plurality of parallel spaced warp yarns with which chain stitches are formed for securing weft yarns laid transverse to the warp yarns as each stitch is formed. Weft yarns of different colors are applied at different times to create a chenille fabric with differently colored sections. Slitting of the fabric in the warp direction between the parallel chain stitches yields individual multi-colored chenille yarns which can be used a flat yarns or twisted to form round chenille yarns.

14 Claims, 6 Drawing Sheets

METHOD OF MAKING MULTI-SEGMENTED CHENILLE YARNS ON A CROCHET KNITTING MACHINE

BACKGROUND OF THE INVENTION

This invention relates to the manufacture of chenille yarns. More specifically, the invention is directed to a method of making multi-segmented chenille yarns on a crochet knitting machine. In multi-segmented chenille yarns, adjacent longitudinal segments of the yarns are formed from different constituent yarns or filaments and can have different physical properties. The invention specifically encompasses making multi-colored chenille yarns without any need for application of dye to the finished yarns by manufacturing chenille yarns with segments formed from constituent yarns or filaments of different colors.

In the prior art, chenille is made in a flat form, or a form having a generally rounded cross section, i.e., akin to a pipe cleaner. The latter, generally round form, is usually more desirable than the flat type of yarn.

Prior art flat chenille yarns are produced on machines specifically made to produce this type of yarn. These machines typically use a form of twisting or spinning yarns around a V-shaped former foot. As the yarns progress down the "V", a circular knife is slid up the "V" for cutting the yarn fibers thereby forming a chenille yarn. Flat chenille yarns are also produced on leno type weaving machines in the form of a fabric which is then slit into flat chenille yarn. The aforementioned prior art methods of producing chenille yarn require specialized machinery which is expensive and consumes valuable space in a yarn-producing factory.

It is also known in the art to knit a fabric from which chenille yarns are obtained by slitting the knitted fabric as is disclosed in U.S. Pat. No. 2,845,783 to Underwood for Chenille Fur Strips and Method of Manufacture. U.S. Pat. No. 1,981,741 to Morton for Manufacture of Chenille also discusses manufacturing chenille by first producing a preparatory cloth and then cutting the cloth into strips which constitute the chenille. U.S. Pat. No. 3,715,878 to Kim for a Process for Making Chenille-Type Yarn discloses the formation of flat chenille yarns by slitting a fabric between warp threads.

Multicolored chenille yarns, that is yarns having longitudinal segments of different colors, are known for use in achieving decorative effects. In order to manufacture such multi-colored yarns, it has heretofore been necessary to dye segments of the yarns along their lengths or sections of fabric from which the chenille yarns are cut. Dyeing is a time consuming and expensive process which can significantly increase the cost of manufacture of multi-colored yarn vis-à-vis conventional monotone yarn. Moreover, because yarns are generally dyed in a wound disposition, spacing between color changes varies along the radius of the winding.

It is known in the art to employ colored filaments in the manufacture of yarns which can have a space-dyed appearance. For example, U.S. Pat. No. 5,613,285 to Chester, et al. for a Process For Making Multicolor Multifilament Non Commingled Yarn teaches how to assemble different colored filaments into a single yarn which can provide multicolor effects rather than a diffused or blended color effect, including a space-dyed appearance and a "chunky appearance." U.S. Pat. Nos. 4,993,218 and 5,056,200 to Schwartz et al. for Textured Yarns And Fabrics Made Therefrom also describe a method for making yarns which can have a space-dyed appearance when multicolored supply yarns are employed. However, neither Chester et al. nor Schwartz et al. disclose how to produce multicolored chenille or chenille-like yarns, or how to produce such yarns on a conventional crochet knitting machine.

SUMMARY OF THE INVENTION

The instant invention overcomes the aforestated shortcomings of prior art methods of making chenille yarn and, in particular, multi-colored chenille yarn, by teaching a method which provides for knitting a fabric on a conventional crotchet knitting machine and applying parallel spaced chain stitches to the fabric in a warp direction transverse to the weft yarns from which the fabric is knitted and parallel to the direction of movement of the fabric through the machine. The introduction and withdrawal of different weft yarns each having unique physical properties, e.g., having differing colors, during the knitting process produces a knitted chenille fabric having a sections formed from different weft yarns which have the color and/or other physical characteristics of the weft yarns from which they are knitted.

Parallel cuts through the fabric are then made between the parallel chain stitches to form flat chenille yarns having alternating colors along their lengths. By interrupting and restarting the application of the weft yarns to the knitting process, gaps my be formed in the knitted fabric which, when longitudinally slit, result in the formation of chenille yarns having spaced slubs.

The flat chenille yarns may be passed through a twisting machine to form chenille yarns having substantially round cross sections. Differently colored weft yarns may be interchanged throughout the knitting cycle to produce multicolored flat or round chenille yarns without having to dye the chenille yarns.

DESCRIPTION OF THE PREFERRED EMBODIMENT

Figure 1:
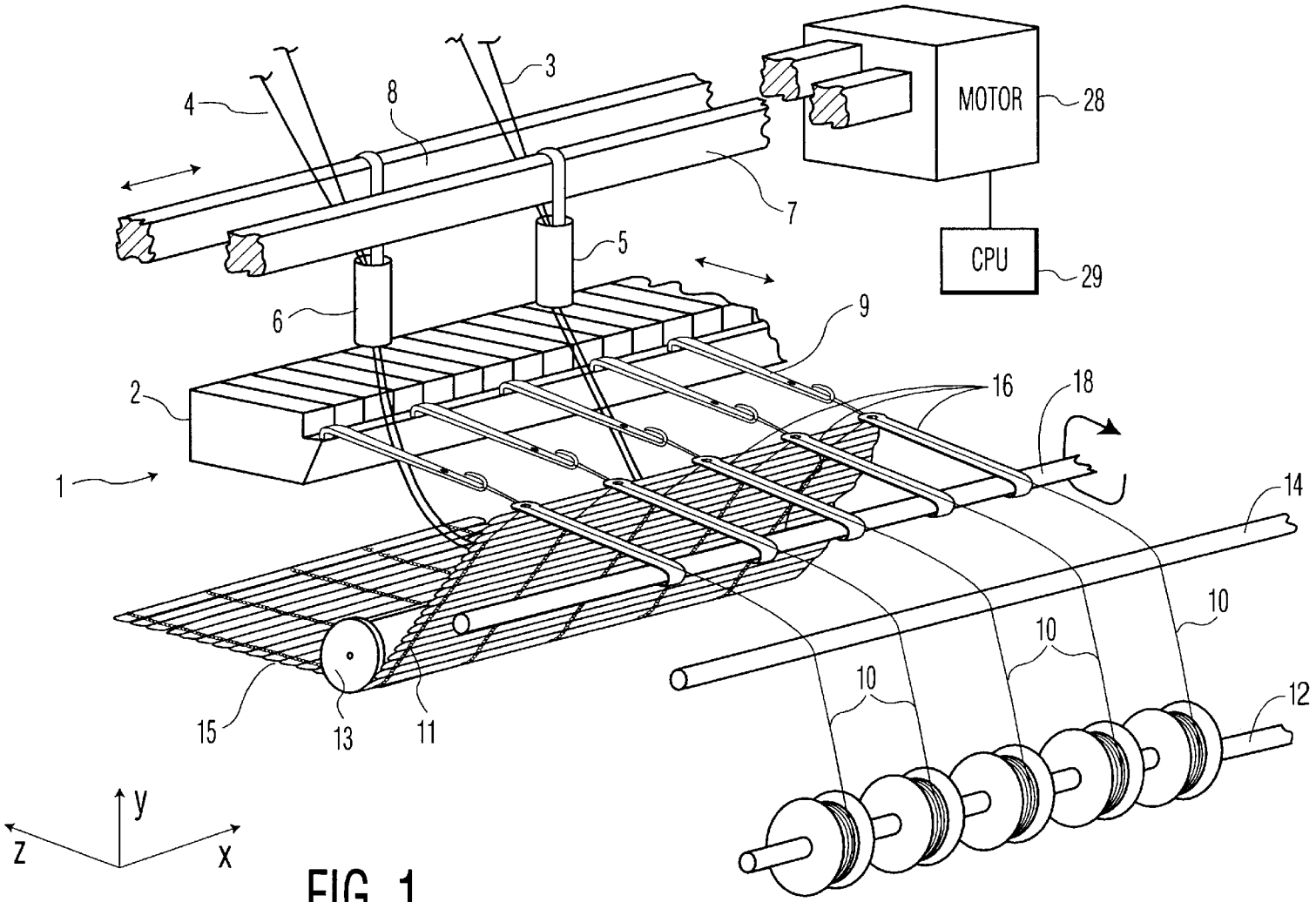
FIG. 1 is a perspective view of a crotchet knitting machine suitable for use in accordance with the preferred embodiment of the invention.

Referring now to FIG. 1 of the drawings, there is shown a crochet knitting machine 1 with a needle bed having a horizontally reciprocable needle gauge 2. Weft yarns 3 from a first creel (not shown) are fed through an inlay tube guide or carrier 5, mounted on a laterally reciprocable weft bar 7. Weft yarns 4 from a second creel (not shown) are fed through an inlay tube guide or carrier 6, mounted on a laterally reciprocable weft bar 8. The weft yarns 3 preferably differ from the weft yarns 4 in one or more physical properties such as weight, texture, and/or most notably, color. Although the physical property of the hereinafter referred to will be color, it is to be understood that as used in the disclosure and claims, the term "color" can include virtually any physical property of a yarn including, without limitation, texture, reflectance, size, and density.

Warp yarns 10 are fed from a beam 12 over a support bar 14 to eyelets 16 mounted on an eyelet bar 18 for guiding the warp yarns 10.

A needle gauge 2, with needles 9 mounted thereon, reciprocates inwardly and outwardly in a direction parallel to the Z axis as shown in FIG. 1. Each time the needles 9 move outwardly, i.e., toward the eyelets 16, each eyelet 16 wraps a segment of a warp yarns 10 threaded therethrough around the shank of a corresponding needle 9. Each time the needles 9 move inwardly, i.e., away from the eyelets 16, a hook on the end of each needle, be it a beard needle or a latch needle, pulls the segment of wrapped warp yarns 10 inwardly to form a loop. Contemporaneously, the previously formed loop is cast off from the needle over the beard or latch of the needle, depending upon whether the needle is of the beard or latch type.

During the portion of each cycle when the needles 9 are in their inward positions, a motor 28 is engaged via gears (not shown) with weft bar 7 causing it to move in the X direction as shown in FIG. 1, for transporting its respective guide carrier 5 across the width of the knitted fabric 15 and laying its corresponding weft yarn(s) 3 over the loops of warp yarns 10 held in the hooks of the retracted needles 9. The needles 9 are then extended for having the next segments of warp yarns 10 wrapped onto their shanks. When the needles are again withdrawn into their inward (retracted) positions, the previous loops are cast off and the segments last wrapped onto the shanks are pulled through the cast off loops entrapping the last transversely laid weft yarns 3 within the chain stitches 11 formed by the interlocking loops of the warp yarns 10.

The cycle is repeated with the needles 9 again being extended. The weft yarn carrier 5 is then moved across the width of the knitted fabric in a direction opposite to its direction of movement in the previous cycle to lay down another length of weft yarns 3 across the warp yarns 10. The needles are again withdrawn to complete the chain stitches 11 and lock the last laid down length of weft yarns 3 into the knitted fabric 15.

The foregoing cycle continues until it is desired to change a physical characteristic of the knitted fabric and, hence, the chenille yarns to be cut from it. For a space dyed effect, the weft yarns in the carrier 5 may be of a single color, e.g. red. The weft yarns in the carrier 6 may be of a different single color, e.g. blue.

In order to change the color of the fabric from red to blue, under control of a computer processor 29, the motor is caused to disengage weft bar 7 and to engage weft bar 8. The next time that the needles 9 are retracted, the weft bar 8 is moved in the X direction to transport carrier 6 containing blue weft yarns 4 which are laid down over the warp yarns 10 extending between the eyelets 16 and needles 9. At this time, the weft bar 7 remains stationary with its carrier 5 outside the width of the knitted fabric 15. The red yarns 3, attached to the side of the web of knitted fabric 15 is drawn from its creel through carrier 5 and is suspended alongside the fabric 15. At any time in the process, the weft bar 8 which transports the carrier 6 having the blue threads can be disengaged from the motor 28 under control of the microprocessor 29 and the weft bar 7 may be reengaged to again introduce red weft yarns into the knitted fabric 15.

Both weft bars 7 and 8 may be engaged by the motor 28 under control of the microprocessor 29 to lay both red and blue weft yarns across the warp yarns 10 during each knitting cycle for still another visual effect. For simplicity, only two weft bars have been shown in FIG. 1. Many additional weft bars, each with its own weft yarn carrier may be included for inserting a different weft yarn into the knitted fabric, either alone or in combination with one or more yarns distributed by the carriers on other weft bars.

Figure 2:
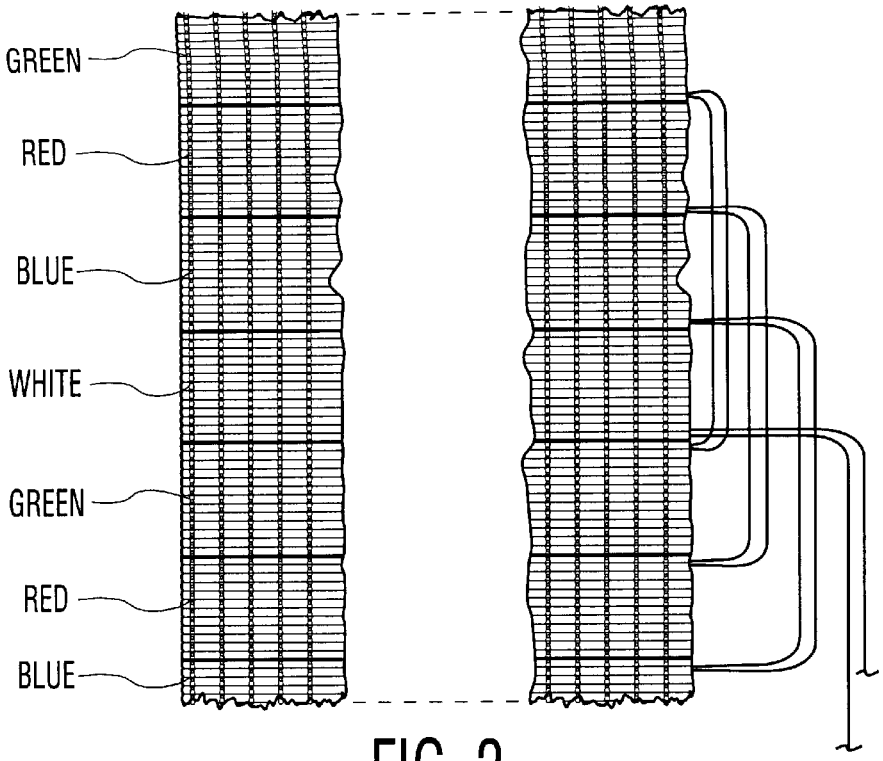
FIG. 2 is a view of a fabric crotchet knitted in accordance with the method of the preferred embodiment of the invention.

Referring to FIG. 2, there is shown a section of a chenille fabric knitted on a crochet knitting machine having four weft bars each with a carrier for respectively feeding green, red, blue and white weft yarns into the fabric 15. In FIG. 2, the weft yarns run horizontally across the page while the warp yarns 10 appear as vertical lines. Along the right side of the fabric are the threads which are suspended, when not being included in the knitted fabric, between successive exit and entry points from and into the fabric.

When the weft bar and carrier applying a green weft yarn to the fabric is disengaged, and the weft bar and carrier containing red yarns is engaged by the motor under control of the microprocessor 29, the green weft yarns are suspended alongside the fabric as it advances through the knitting machine until the weft bar and carrier which feeds the green yarns is, again, engaged, at which time the green yarns enter the fabric. The same occurs for the red, blue and white weft yarns as seen in FIG. 2. The suspended segments of the weft yarns can be trimmed and discarded or recycled.

Figure 3:
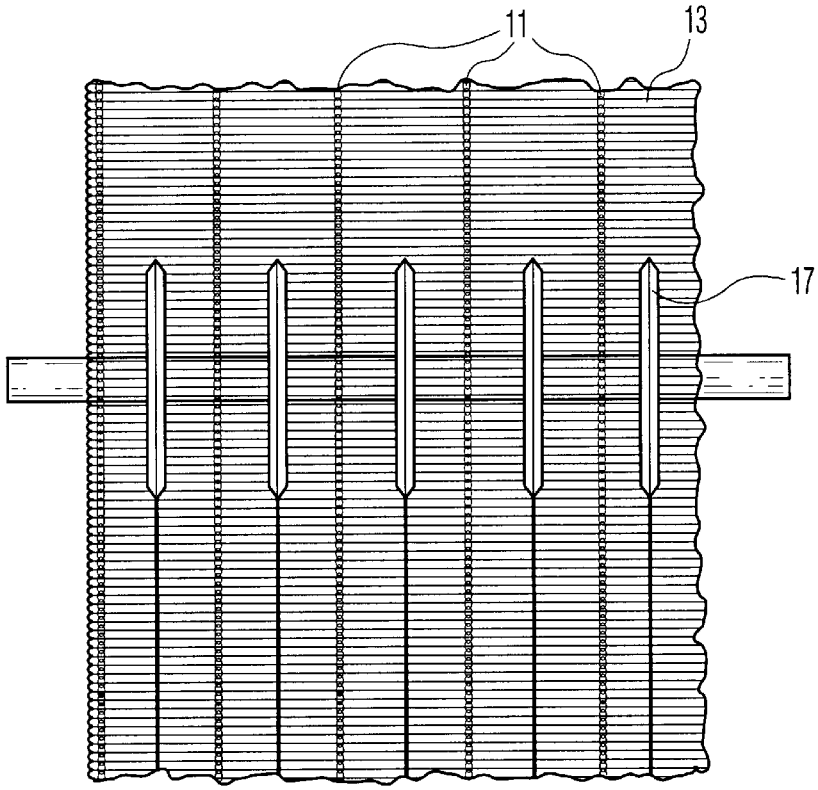
FIG. 3 is a view of the crotchet knitted fabric shown in FIG. 2 as it is being slit into individual chenille yarns in accordance with the method of the preferred embodiment of the invention.
Figure 4:
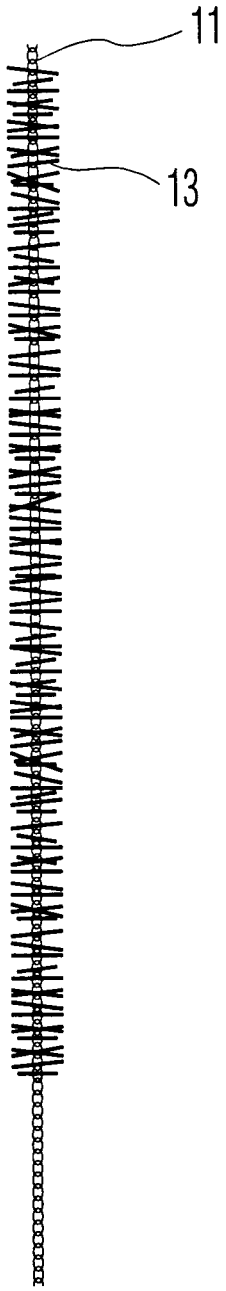
FIG. 4 is a view of a segment of one of the individual chenille yarns made in accordance with the method of the preferred embodiment of the invention.

Referring additionally to FIG. 3, the knitted fabric containing the weft yarns, all locked together by the chain stitches 11 formed from the warp yarns 10, is fed about a take-up roller 13 (FIG. 1) and then passes over spaced circular rotating knives 17 for cutting the fabric between the warp yarns 10 having chain stitches 11, thereby creating a group of individual strips of fibers, each locked in place by a central axial chain stitch 11 as can be readily seen in FIG. 4. Each of the produced strips is a flat chenille yarn.

Figure 5:
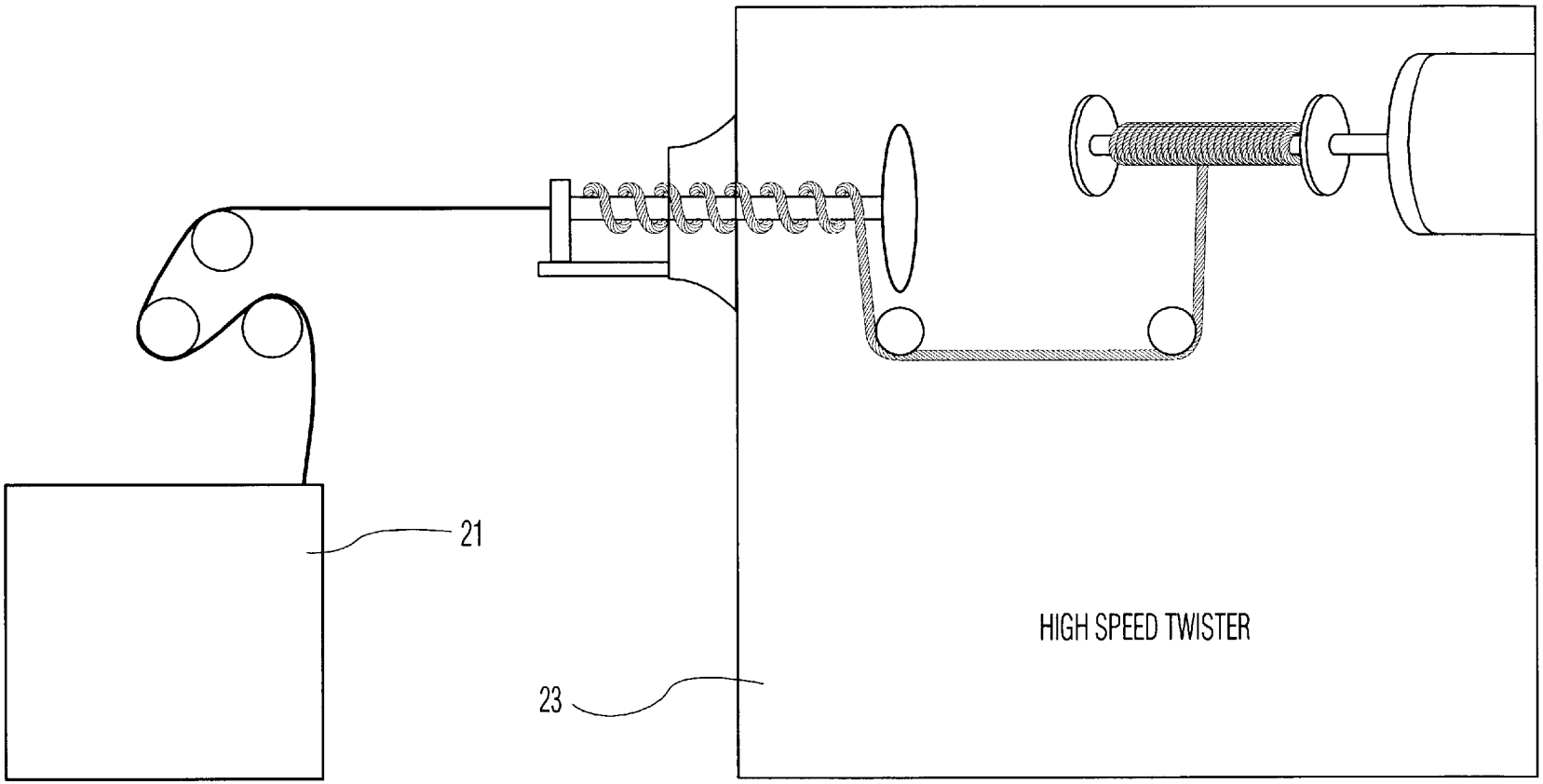
FIG. 5 is a schematic view of a twisting machine for producing chenille yarns having a substantially round cross section in accordance with the preferred embodiment of the invention.

Referring now to FIG. 5, in order to produce chenille yarns which are substantially round in cross section, i.e., pipe cleaner-like, flat chenille yarns 21 are produced as described above. The flat chenille yarns are then passed through a high speed twister 23 creating a round chenille. The more twists per foot, the more round is the chenille yarn. Heat and/or steam can also be applied to the flat chenille for causing the yarn fibers to explode open.

The above-described process can be used with numerous types of yarn fibers including pre-dyed acrylic fibers such as supplied by Finetex Yarn Company which offers fibers in a complete color range and in a 2/24 acrylic.

Yield is conventionally measured in units of yarns per pound (ypp). The yield of the chenille yarn can be changed, e.g., by adding or removing the number of fibers or yarns fed into the laterally reciprocating weft carriers 5, 7, or by spacing the crocheting knitting needles 9 and their respective eyelets 16 closer, or further apart. The lower the yield, the greater is the diameter of the resulting round chenille yarn or the width of the flat chenille yarn. The greater the yield, the finer or thinner is the chenille yarn.

Figure 6:
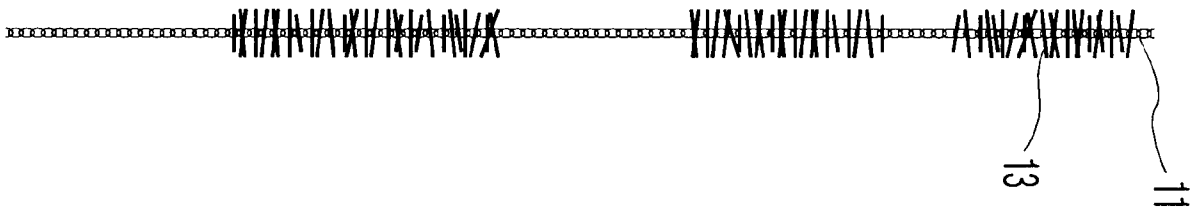
FIG. 6 is a view of a segment of one of the individual chenille yarns, made in accordance with the method of the preferred embodiment of the invention, having spaced slubs.

The above described process of the invention also permits the manufacture of chenille yarns having slubs spaced along their lengths. That is, chenille yarns can be fabricated with segments having weft yarns anchored by a central longitudinally running chain stitch 11, interspersed with segments having no weft yarns, but only warp yarns 10 forming a narrow thread running between the weft yarn-containing segments as seen in FIG. 6.

Figure 7:
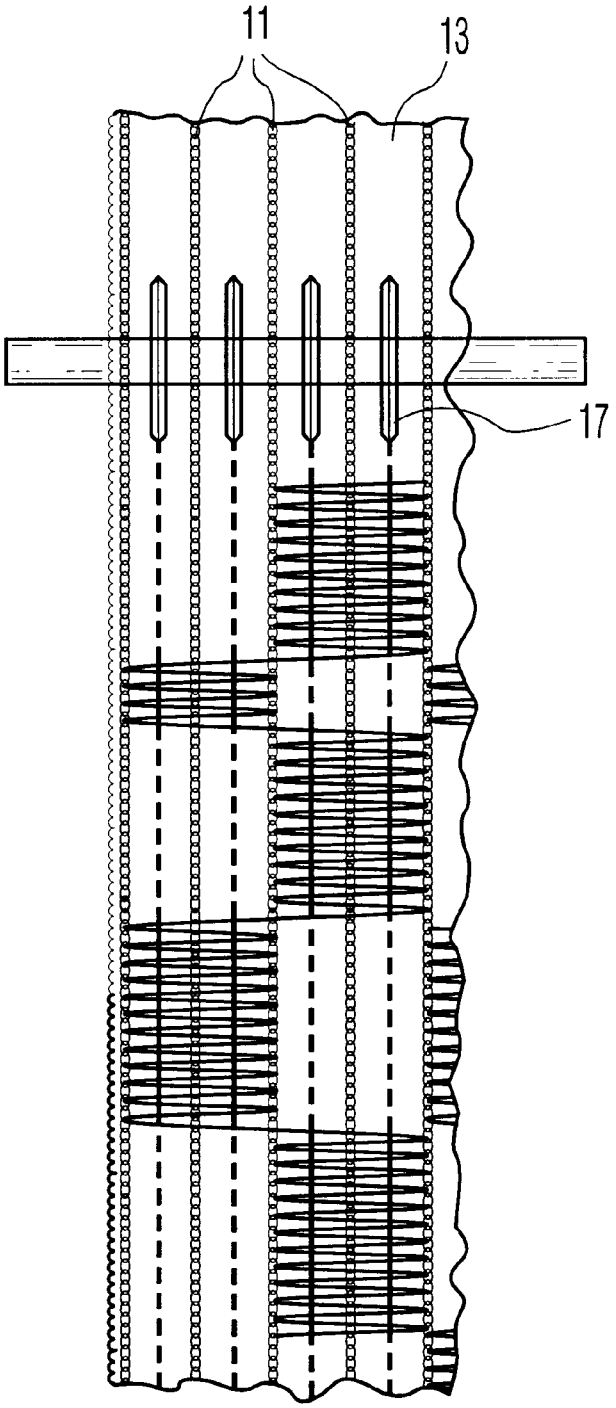
FIG. 7 is a view of an alternate form of a crotchet knitted fabric, made in accordance with the method of the preferred embodiment of the invention, as it is being slit into individual chenille yarns having spaced slubs.

A fabric can be knitted with the microprocessor 29 programmed to have the weft bars and their carriers traverse the entire width of the knitted fabric, or, as shown in FIG. 7, to traverse bands of the fabric narrower than the entire fabric width. The result is a chenille fabric having parallel bands running in the warp direction, each of which has differing spaced segments which alternately include weft yarns and have no weft yarns.

In FIG. 7 there is shown a chenille fabric which can be formed using only a single weft bar and carrier. In the fabrication of the fabric of FIG. 7, the weft yarn carrier has been caused to reciprocate within the boundaries of one band of the fabric while an adjacent band receives no weft yarns. The carrier then reciprocates within the boundaries of the adjacent band for inserting weft yarns there while the other band now receives no weft yarns, thereby causing a checkerboard effect. A solid checkerboard effect can be obtained by applying two or more yarns of different colors to respective different bands, simultaneously, thereby creating a chenille yarn fabric having bands of different alternating color patterns each of which runs in the warp direction and each of which is displaced from an adjacent band in the weft direction.

Slitting of the chenille fabric shown in FIG. 7 on rotary cutters 17 results in the formation of chenille yarns having slubs with different spacings among adjacent yarns.

It is to be appreciated that the foregoing is a description of a preferred embodiment of the invention to which variations and modifications may be made without departing from the spirit and scope of the invention. Numerous effects may be obtained by varying the number and colors of weft yarns inserted into the chenille fabric, the boundaries of the bands of weft yarns that are laid down, the spacings between weft yarns, the distance between warp yarns as well as weft yarns, and the degree of twisting of the flat chenille yarns to form round chenille yarns.

What is claimed is:

1. A method of making chenille yarns on a crochet knitting machine comprising:

knitting together, on said crochet knitting machine, a plurality of warp warns and a first weft yarn to commence formation of a knitted chenille fabric, said first weft yarn being of a first color and laid back and forth across the full width of the fabric, interrupting the knitting together of said first weft yarn and said warp yarns, suspending a segment of said first weft yarn adjacent said chenille fabric, commencing knitting together a second weft yarn and said warp yarns for continuing the formation of said knitted chenille fabric, said second weft yarn being of a second color, different from said first color, and laid back and forth across the full width of the fabric interrupting the knitting together of said second weft yarn and said warp yarns, suspending a segment of said second weft yarn adjacent said chenille fabric, whereby said knitted chenille fabric has a first section formed solely from said one weft yarn and said warp yarns, in which said second weft yarn is not present, and a section formed solely from said second weft yarn and said warp yarns in which said first weft yarn is not present, cutting said first weft yarn segment for separating it from said knitted chenille fabric, cutting said second weft yarn segment for separating it from said knitted chenille fabric, and cutting the knitted chenille fabric, intermediate said warp yarns, in a direction substantially parallel to the warp yarns and substantially transverse to the weft yarns for forming a plurality of substantially identical strips of the knitted chenille fabric, each of said strips including a chenille yarn having a first length formed from said first weft yarn and said warp yarns, and a second length formed from said second weft yarn and said warp yarns.

2. A method of making chenille yarns on a crochet knitting machine according to claim 1 further comprising rotating said chenille yarn about a longitudinal axis thereof to form a round chenille yarn.

3. A method of making chenille yarns on a crochet knitting machine in accordance with claim 1 further comprising commencing knitting together said second weft yarn and said warp yarns substantially immediately upon interrupting the knitting together of said first weft yarn and said warp yarns whereby said section formed from said first weft yarn and said warp yarns, and said section formed from said second weft yarn and said warp yarns are immediately adjacent one another, and said first length of each of said chenille yarns is immediately adjacent said second length of each of said chenille yarns.

4. A method of making chenille yarns on a crochet knitting machinecomprising knitting together, on said crochet knitting machine, a plurality of warp warns and at least one weft yarn to form a knitted chenille fabric, said one weft yarn being of a first color, interrupting the knitting together of said one weft yarn and said warp yarns, delaying commencing knitting together a second weft yarn and said warp yarns for a predetermined time after interrupting the knitting together of said one weft yarn and said warp yarns, commencing knitting together said second weft yarn and said warp yarns for forming a knitted chenille fabric having a section formed from said one weft yarn and said warp yarns, and a section formed from said another weft yarn and said warp yarns, and cutting the knitted chenille fabric, intermediate said warp yarns, in a direction substantially parallel to the warp yarns and substantially transverse to the weft yarns for forming a plurality of strips of the knitted chenille fabric, each of said strips comprising a chenille yarn having a first length formed from said one weft yarn and said warp yarns, and a second length formed from said another weft yarn and said warp yarns, said one weft yarn being of a first color and said second weft yarn being of a second color different from said first color whereby said first length of each of said chenille yarns has said first color and said second length of each of said chenille yarns has said second color, whereby each of said chenille yarns is a multicolored chenille yarn, and whereby said section formed from said one weft yarn and said warp yarns, and said section formed from said second weft yarn and said warp yarns are spaced from one another, and said first length of each of said chenille yarns comprises a first slub spaced from a second length of said each one of said chenille yarns which second length comprises a second slub of said each one of said chenille yarns.

5. A chenille fabric comprising a plurality of parallel spaced warp yarns forming chain stitches running in a warp direction, a first section of weft yarns of a first color spanning the entire width of said fabric in a weft direction transverse to said warp direction and secured by said chain stitches, and a second section of weft yarns of a second color spanning the entire width of said fabric in said weft direction secured by said chain stitches, said second section being displaced from said first section in the warp direction, and said first and second sections being uniform across the width of said fabric whereby cutting said fabric between said chain stitches yields substantially identical strips of said fabric for forming chenille yarns.

6. A chenille fabric according to claim 5 wherein said first section and said second section are immediately adjacent to one another.

7. A chenille fabric according to claim 5 having a single central chain stitch running in the warp direction, a first segment of weft yarns of a first color running in a weft direction transverse to said warp direction and secured by said chain stitches, and a second section of weft yarns of a second color running in said weft direction secured by said chain stitches, said second section being displaced from said first section in the warp direction, said chenille fabric comprising a chenille yarn.

8. A chenille yarn according to claim 7 wherein said first segment and said second segment are immediately adjacent to one another.

9. A chenille fabric according to claim 5 wherein said first section and said second section are spaced from one another.

10. A chenille yarn according to claim 7 wherein said first segment and said second segment are spaced from one another for forming slubs separated by segments of said central warp yarn.

11. A chenille fabric according to claim 5 comprising bands of differing colors, said bands running in the warp direction and displaced from one another in the weft direction, each of said bands having at least one weft yarn of a color different from the color of an adjacent weft yarn in an adjacent band.

12. A chenille fabric according to claim 11 wherein a single length of weft yarn is alternately applied in different ones of said bands whereby sections of said weft yarns in each band are mutually spaced apart.

13. A chenille fabric according to claim 11 wherein different weft yarns are alternately applied in different ones of said bands.

14. A method according to claim 1 further comprising laying said suspended segment of said first weft yarn back and forth across the full widty of said knitted chenille fabric after interruption of the knitting together of said second weft yarn and said warp yarns to reintroduce said first weft yarn into said knitted chenille fabric.

* * * * *